US005836255A

United States Patent [19]

Uitz

[11] Patent Number: 5,836,255

[45] Date of Patent: Nov. 17, 1998

[54] PALLET FOR ERECTED AND COLLAPSIBLE CONTAINER/PALLET SYSTEM

[76] Inventor: Mark O. Uitz, 1050 Crest View Dr. Suite C15, Mountain View, Calif. 94040

[21] Appl. No.: 631,633

[22] Filed: Apr. 8, 1996

[51] Int. Cl.[6] ..... B65D 19/00

[52] U.S. Cl. ..... 108/57.25

[58] Field of Search ..... 108/56.1, 56.3, 108/51.11, 901, 55.3, 57.25

[56] References Cited

U.S. PATENT DOCUMENTS

| | | | |
|---|---|---|---|
| 2,990,058 | 6/1961 | Williams . | |
| 3,126,843 | 3/1964 | De Laney . | |
| 3,315,800 | 4/1967 | Wagner | 108/55.3 X |
| 3,540,385 | 11/1970 | Hobart . | |
| 3,557,512 | 1/1971 | Braeuninger et al. . | |
| 3,610,173 | 10/1971 | McIlwarth et al. . | |
| 3,626,869 | 12/1971 | Colas | 108/51.1 |
| 3,664,271 | 5/1972 | Wolder et al. . | |
| 3,678,868 | 7/1972 | Hirota . | |
| 3,720,176 | 3/1973 | Munroe . | |
| 3,814,031 | 6/1974 | Fowler . | |
| 3,814,280 | 6/1974 | Ward . | |
| 3,878,796 | 4/1975 | Morrison . | |
| 3,954,067 | 5/1976 | Miles | 108/51.1 X |
| 3,989,140 | 11/1976 | Crane . | |
| 4,013,021 | 3/1977 | Steinlein et al. . | |
| 4,316,419 | 2/1982 | Cupido . | |
| 4,597,338 | 7/1986 | Kreeger . | |
| 4,597,339 | 7/1986 | MaCaffrey et al. | 108/51.1 X |
| 4,735,154 | 4/1988 | Hemery | 108/56.1 |
| 4,843,976 | 7/1989 | Pigott et al. . | |
| 5,197,395 | 3/1993 | Pigott et al. . | |
| 5,388,533 | 2/1995 | Pigott et al. | 108/56.1 X |
| 5,450,962 | 9/1995 | Uitz . | |
| 5,458,069 | 10/1995 | Stolzman | 108/56.3 |
| 5,497,708 | 3/1996 | Jeruzal | 108/55.3 X |

FOREIGN PATENT DOCUMENTS

| | | |
|---|---|---|
| 0 152 323 | 8/1985 | European Pat. Off. . |
| 0 251 439 | 1/1988 | European Pat. Off. . |
| 1322667 | 5/1962 | France . |
| 2.140.093 | 5/1972 | France . |
| 2 140 093 | 1/1973 | France . |
| 2 291 101 | 6/1976 | France . |
| 2697502 | 5/1994 | France . |
| 2 365 344 | 9/1974 | Germany . |
| 25 16 108 | 10/1976 | Germany . |
| 3011-139 | 10/1981 | Germany . |
| 401658 | 11/1991 | Germany . |
| 1005589 | 9/1965 | United Kingdom . |
| 1 459 433 | 6/1976 | United Kingdom . |
| 1585143 | 9/1980 | United Kingdom . |
| 91/13810 | 9/1991 | WIPO . |
| 94/22728 | 10/1994 | WIPO . |

OTHER PUBLICATIONS

Enviro–Board, MBX Packaging Specialists, Undated flier.
Global Equipment Co., undated catalog, pp. 58–59.
Menasha Corporation, Convoy Plastic Pallets, Undated flier.

*Primary Examiner*—Jose V. Chen
*Attorney, Agent, or Firm*—Flehr Hohbach Test Albritton & Herbert

[57] ABSTRACT

Three embodiments of a plastic pallet and accompanying top frames are described. The parts of the pallets and top frames are formed from extruded stock, and many of such parts are made from the same or similar stock. In its basic aspects, all embodiments of the pallet include top and bottom sections which are spaced from one another by spacer blocks which are formed from a common piece of plastic stock. Most desirably, each of these spacer blocks is generally hollow with strengthening webbing but is oriented relative to the top and bottom decks so that the latter close those opposed ends at which the hollow interior and webbing otherwise would be exposed. The design is such that exposed ends of other parts of the pallet are similarly closed by other parts.

11 Claims, 10 Drawing Sheets

PALLET FOR ERECTED AND COLLAPSIBLE CONTAINER/PALLET SYSTEM

BACKGROUND OF THE INVENTION

The present invention relates to a pallet for handling, transporting and storing containers for goods and, more particularly, to a rugged plastic pallet construction that is relatively inexpensive.

While plastic pallets are not new, from the commercial standpoint their use generally has been limited to the movement of containers and goods within a closed space, such as within a warehouse. One reason for this is that plastic pallets are relatively expensive and owners typically feel the need to maintain control. Another reason for this is that many plastic pallets generally are not sufficiently rugged to withstand the abuse they would find in general use. In this connection, most plastic pallets today are either molded or vacuum formed as a whole unit, or are made from parts that are either molded or vacuum formed. Although the resulting integral pallet is generally fairly resistant to abuse, these manufacturing approaches have been a major contributor to the cost of plastic pallets. While some have made pallets by extruding parts (see U.S. Pat. No. 3,878,796 and the pallet offered by NBX Packaging Specialists of Wausau, Wis., with the trademark Enviro-board), in general these pallets are not designed to take advantage of the extrusion manufacturing process or the part connection techniques usable with the same.

Applicant has developed a reusable plastic container (see U.S. Pat. No. 5,450,962) and has invented a plastic pallet especially adapted for use with such container. Applicant had to address many of the problems associated with existing plastic pallets in developing his own.

SUMMARY OF THE INVENTION

The present invention provides a lightweight and relatively low-cost plastic pallet that is sufficiently rugged for general use. Such pallet is made in different parts and sections that are extruded. Most advantageously, many of such parts duplicate others and are creatable from common plastic stock. A major consequence is that such plastic pallet is relatively inexpensive. The design of the same, though, provides the ruggedness that is needed for general use. Such design also addresses disadvantages associated with the manufacturing approach. Moreover, the design is such that reliance can be made on piece welding techniques which provide a rugged pallet construction.

In its basic aspects, the pallet of the invention includes top and bottom deck sections that are spaced from one another by spacer blocks formed from a common piece of plastic material. Most desirably, the spacer block stock is extruded with a hollow interior, but with strengthening webbing to support the walls, and each is oriented relative to top and bottom decks so that the latter close those opposed ends of the blocks exposing the interior and its webbing. The top and bottom deck sections also most desirably are designed to be formed from a few extruded pieces, some of which are usable for both decks. Moreover, the various pieces are designed to facilitate use of rugged and reliable connection techniques as will be described.

The major features of the pallet of the invention are usable not only to provide a pallet capable of many uses, but also to provide specific pallets, e.g., one designed to interact with containers of the type covered by the above patent when they are erected and another designed to interact with such containers when they are collapsed.

Other features and advantages of the invention either will become apparent or will be described in connection with the following, more detailed description of preferred embodiments of the invention and variations.

BRIEF DESCRIPTION OF THE DRAWING

With reference to the accompanying drawing.

DETAILED DESCRIPTION OF THE PREFERRED EMBODIMENT(S)

The following relatively detailed description is provided to satisfy the patent statutes. It will be appreciated by those skilled in the art that various changes and modifications can be made without departing from the invention.

Figure 1:
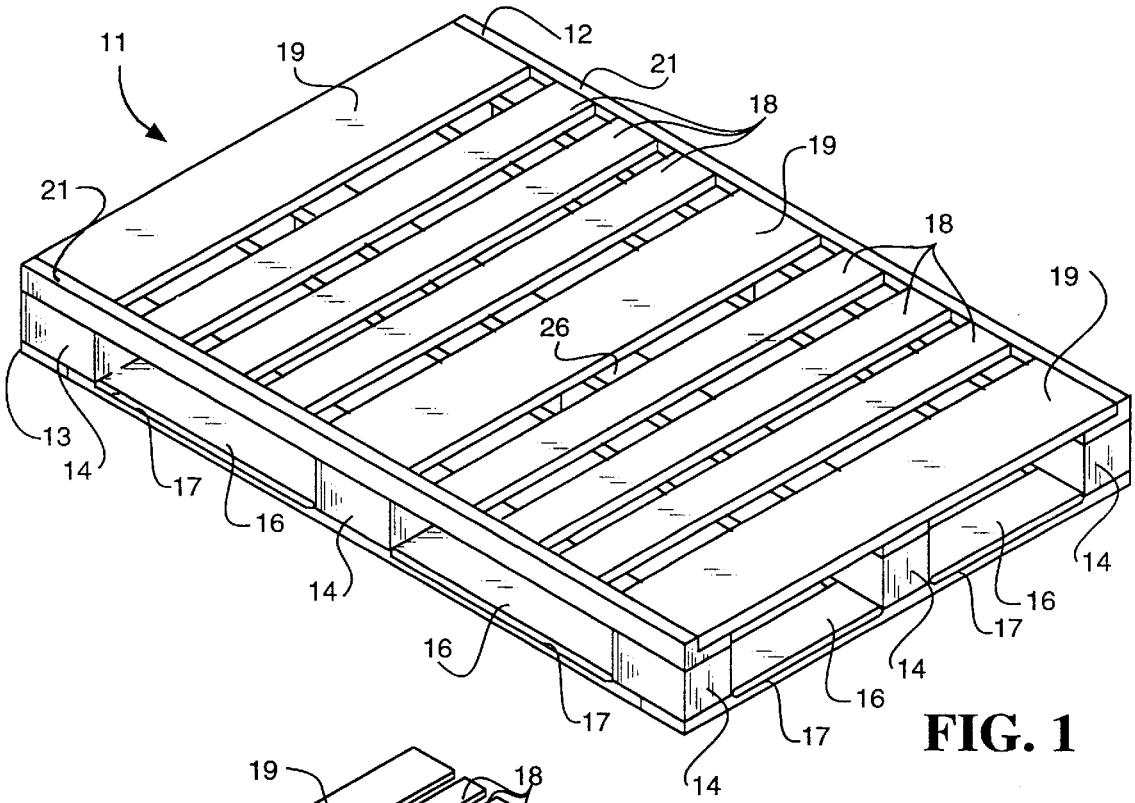
FIG. 1 is an isometric view of a preferred embodiment of a pallet incorporating the invention.
Figure 2:
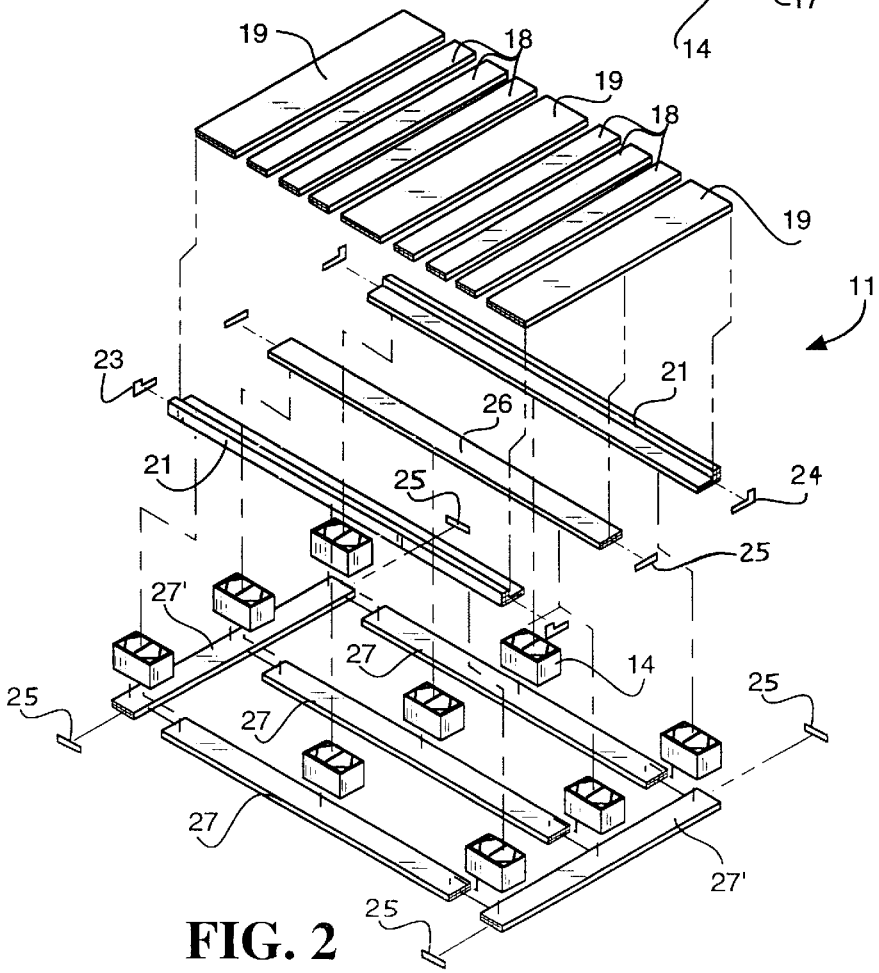
FIG. 2 is an exploded, somewhat schematic isometric view of the pallet of FIG. 1.

A plastic pallet of the invention is generally referred to in FIGS. 1 and 2 by the reference numeral 11. Such pallet includes a top deck section 12 having an upper surface for interaction with containers or other material to be placed on the pallet, a bottom section 13 for interaction with a supporting surface, such as the ground or a floor with which the pallet is to rest, and a plurality of blocks 14 that space the decks 12 and 13 from one another. As illustrated in FIG. 1, spacer blocks 14 are positioned to define channels 16 between the decks for receipt in accordance with conventional practice of pick-up tines of a forklift or the like. In this connection, the frame pieces defining the bottom deck are chamfered as indicated at 17 to facilitate receipt of tines in channels 16.

Pallet 11 is made up essentially of a plurality of parts that are extruded. And, as will be discussed in more detail below, many of the extruded parts are the same as others so that common pieces of extruded stock can be used. These parts are so assembled and connected together that a unitary structure is defined.

In more detail, although the top deck section has about a dozen major parts, the design is such that only three different pieces of extruded plastic stock need to be provided. All of such major parts can be formed from these three pieces. That is, although the implementation of the preferred embodiment used to illustrate the invention includes nine cross bars, six of these cross bars denoted by the reference numeral 18 are made from a single piece of extruded stock whereas the other three, denoted by the reference numeral 19, are made from another. (As discussed below, the same extruded stock from which the cross bars 18 are formed is usable to form the major components of the bottom deck.)

The top deck section further includes a pair of spaced apart edge boards 21. Each of these edge boards is L-shaped in section, with one leg abutting and closing corresponding open ends of the cross bars 18 and 19, and the other leg of each providing significant surface area for connection to the slats.

The slats are connected to the edge boards in a manner which assures a reliable connection while avoiding extraneous types of material, such as provided by fasteners. This is accomplished most simply by vibration welding. To this end, the surface 22 (FIG. 3A) of each of the edge boards includes a plurality of vibration welding energy directors 23 extending along its length. An enlarged sectional view of one of such energy directors is shown in FIG. 3B. These energy directors facilitate the vibration welding to the surface 22 of the corresponding ends of the cross bars. As is known, vibration welding is obtained by vibrating the surfaces to be adhered together relative to one another. The energy directors 23 act as linear energy and material concentrators to facilitate such vibration welding.

Although the pallet of the invention was designed with vibration welding in mind, it will be recognized by those skilled in the art that other types of welding, such as hot plate welding, are also possible.

Figure 3A:
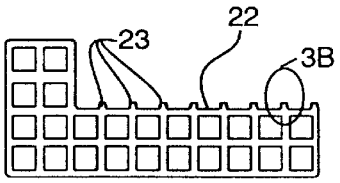
FIG. 3A illustrates a sectional view of an edge board for the top deck section of the pallet of FIG. 1.
Figure 3C:
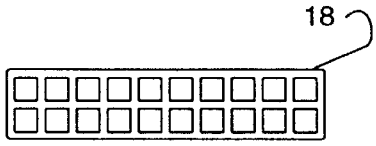
FIG. 3C is an end view of a narrower one of the cross bars incorporated into the top deck section of the embodiment of FIG. 1.
Figure 3F:
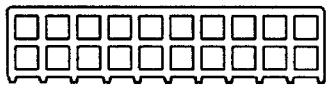
FIG. 3F an end view similar to FIG. 3C showing the end of a narrower one of the cross bars as it is incorporated into the top frame assembly of FIG. 5.
Figure 3B:
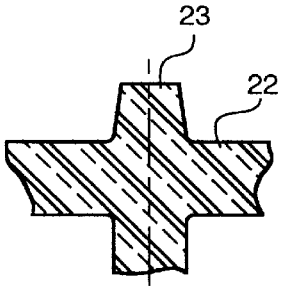
FIG. 3B is an enlarged, partial schematic view of the area of the edge board of FIG. 3A encircled by the line 3B, showing a typical construction of an energy director.
Figure 3D:
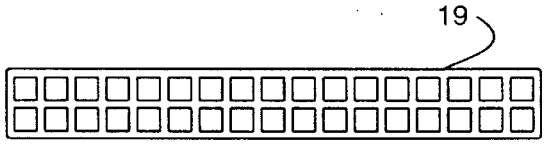
FIG. 3D is an end view of a broader (wider) one of the cross bars of the top deck section of the embodiment of FIG. 1.

As illustrated in FIG. 3A, the edge boards have an egg crate construction. That is, each is hollow in its interior with webbing similar to that found in egg crates and other packaging arrangements in which it is desired to separate individual fungible goods, extending between the walls and providing support. This type of construction is significantly lighter in weight than a solid construction, and its inclusion in the edge boards contributes to the lightness of the total pallet structure. As illustrated in FIGS. 3C and 3D, the cross bars 18 and 19 also have an egg crate construction to provide their exterior walls with the strength needed in a pallet and yet to be light weight.

It is to be noted that the design of the top deck is such that the open ends of the cross bars 18 and 19 are closed by the edge boards. This is important since it prevents insects and debris from collecting within such cross bars. Edge board end caps 24 (FIG. 2) are included to avoid the same problems with the edge boards. The top deck section further includes a center board 26 which extends between the ends of the pallet orthogonal to cross bars 18 and 19. Such center board is not secured to the cross bars but rather is secured to those spacer blocks 14 which engage the same. End caps 25 for such center board are also provided.

Bottom deck section 13 is made up primarily by elongated slats 27, three of which are parallel to top section center board 24 and two of which, those denoted by the reference numeral 27', are end slats. All of these elongated slats 27 and 27' are the same as top section cross bar 18 and thus are most desirably formed from the same piece of extruded stock as such cross bars. As can be seen from FIG. 2, the construction is such that the end slats 27' close the open ends of the other elongated slats. Caps 25 are also included closing the ends of the end slats as is illustrated.

Vibration welding is also usable to secure the various elongated slats together. In this connection, the exposed egg crate constructions at the ends of the slats 27 and 27' act as energy directors to facilitate such vibration welding.

It will be seen from the above description that while the pallet is made from numerous parts, most of them are formed from common pieces of extruded stock. Because of the design of the pallet, the open ends of many of the parts are closed by other extruded parts. The number of end caps is kept to a minimum. Only the end caps 24 and 25 need to be provided. These end caps can be injection molded, and since numerous pallets can be made at one time, the mold cost per cap is kept to a minimum.

Figure 3G:
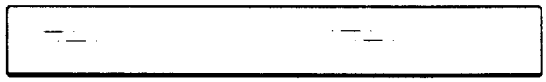
FIG. 3G is an end view of the board incorporated into the top frame assembly of FIG. 5, which board is similar to that of FIG. 3D.
Figure 3E:
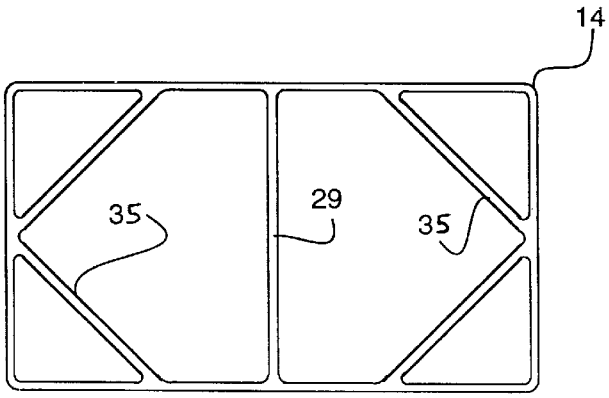
FIG. 3E illustrates an end of a spacer block incorporated into the embodiment of FIG. 1.

As mentioned previously, the top and bottom deck sections are spaced from one another by spacer blocks 14. Each of these spacer blocks is a hollow rectangle that includes internal webbing to support its walls. That is, as is illustrated in FIG. 3E, each spacer block includes an internal webbing cross wall 29 that extends between the center lines of each of the long walls of the block, and an pair of opposed chevrons 35 respectively connecting the center of the shorter opposed walls to a portion of the long walls.

Each of the blocks 14 is oriented relative to the decks that such decks close the opposed ends of the respective blocks. This is best illustrated in FIG. 2. The webbing ends also act as energy directors to facilitate vibration welding of the blocks in place holding the deck sections together. The chamfered edges 17 are provided after the blocks 14 are adhered to the bottom deck, by using heat and pressure to press the edges of the slats externally as appropriate.

Figure 4:
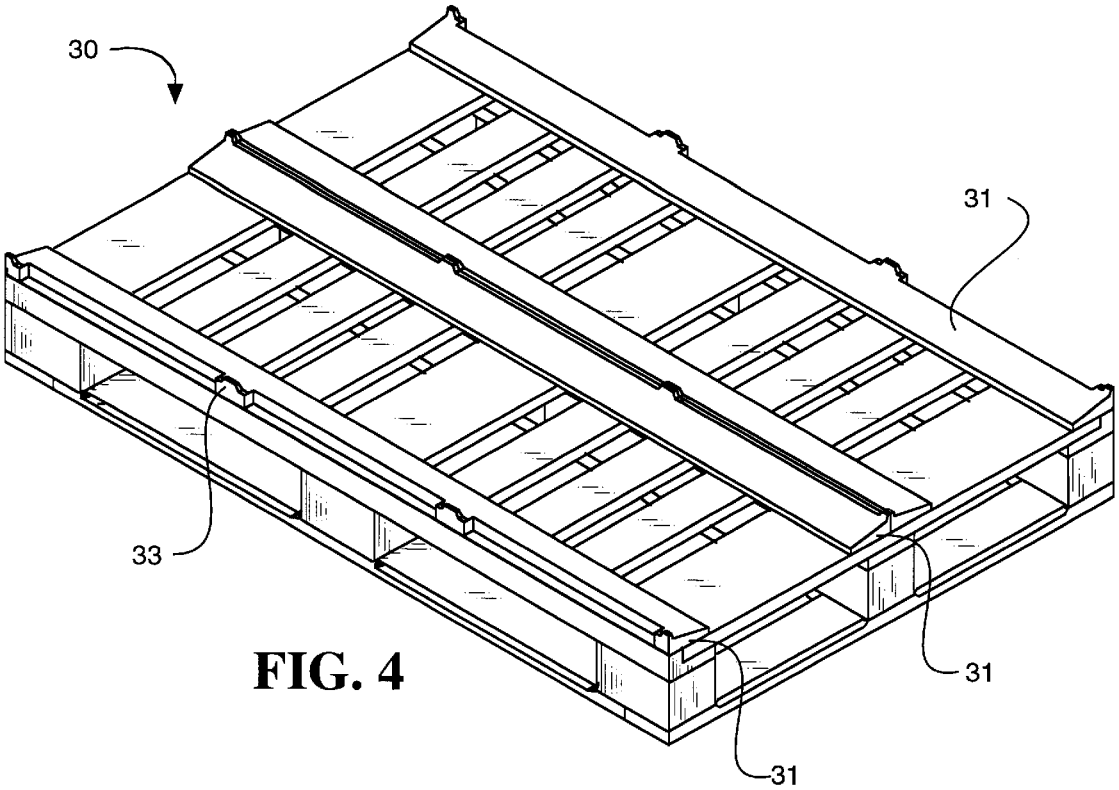
FIG. 4 is an isometric view similar to FIG. 1 of another embodiment of the invention, having container interlock strips to interact with containers of the type disclosed in U.S. Pat. No. 5,450,982.
Figure 4A:
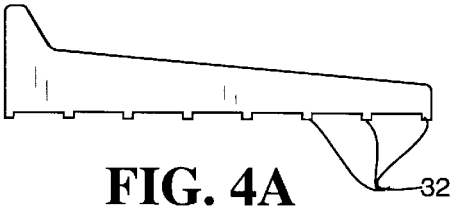
FIG. 4A is an enlarged end view of an interlock strip of the pallet of FIG. 4, illustrating the configuration of such strip.
Figure 5:
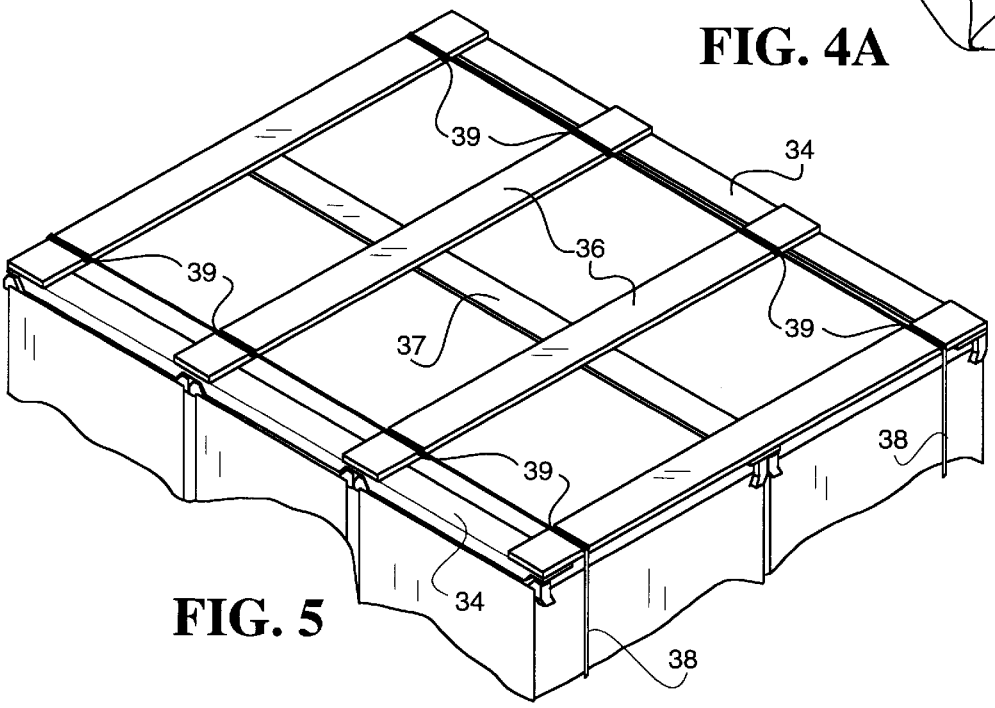
FIG. 5 is a broken away isometric view showing a top frame usable with the FIG. 4 embodiment of the invention.
Figure 6B:
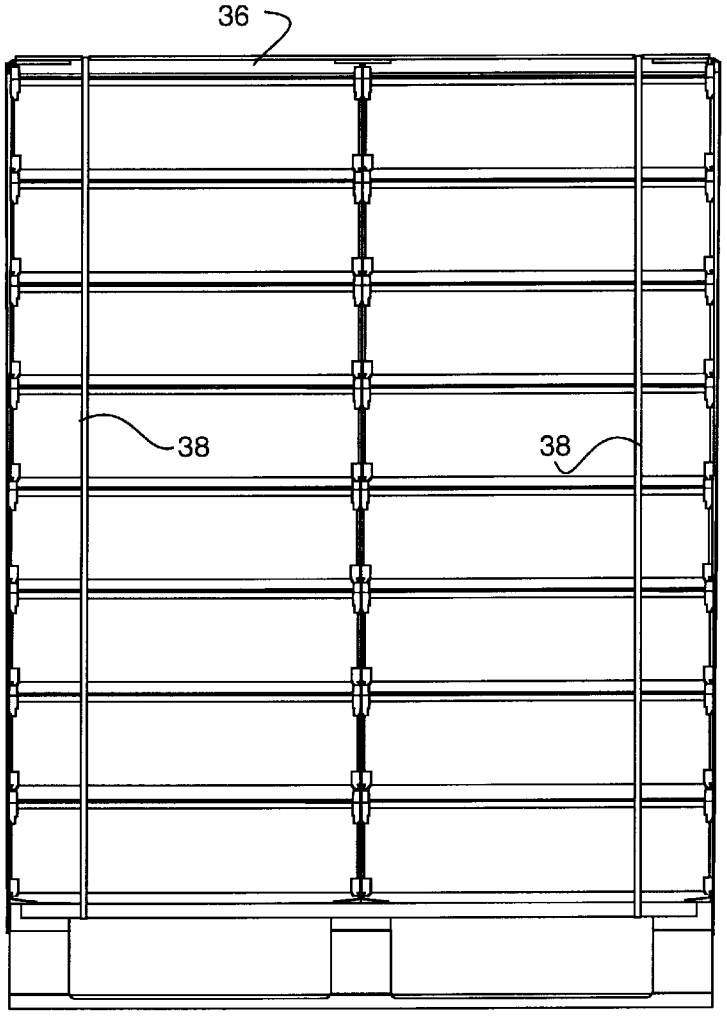
FIG. 6B is a side view similar to FIG. 6A.
Figure 6A:
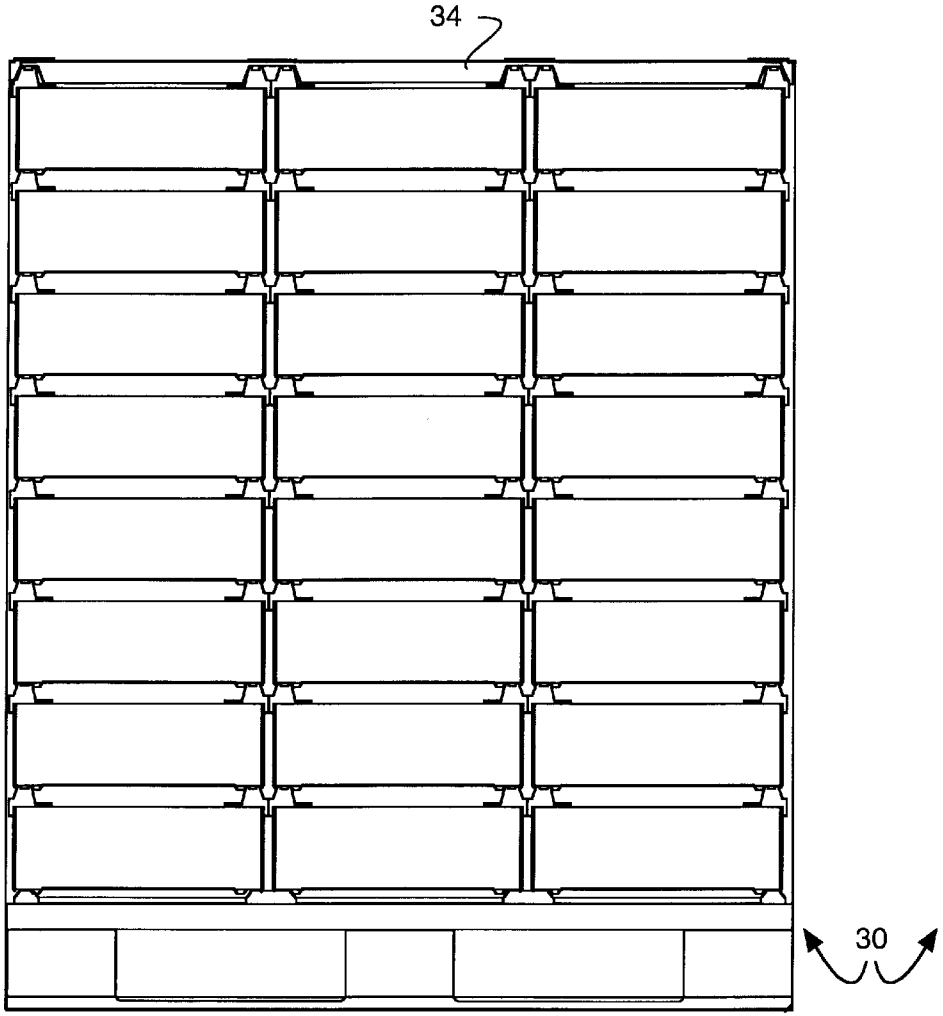
FIG. 6A is a front view of the pallet of FIG. 4 loaded with erected containers, showing the same with the top frame of FIG. 5.

The pallet of the invention easily is adaptable to interface with plastic containers of the type disclosed in U.S. Pat. No. 5,450,962. That is, slight additions and modifications can be made to the basic pallet to provide specialized pallets for erected containers and for collapsed containers. FIGS. 4 and 4A illustrate an addition to the basic pallet for an erected container of such type. FIG. 5 illustrates a top frame which will be discussed hereinafter, and FIGS. 6A and 6B illustrate the pallet used with stacked, erected containers.

The specialized pallet 30 of FIG. 4 has container cleat runners or interlocking strips 31 adjacent each of its edges. Two of the runners are also placed back to back as illustrated along the center of the pallet parallel to the edge cleat runners. It therefore will be seen that two rows of erected containers can be accommodated by each pallet. All of the cleat runners are vibration welded in place. FIG. 4A shows an end of a runner. It will be seen that the stock for the runner is such that each of the runners includes energy directors 32 to facilitate vibration welding.

Each runner provides upstanding cleats 33 to engage the bottom edges of the containers. In the embodiment being described, the runners are relieved to provide such cleats, i.e., some of the extruded material is removed.

A top frame is provided to aid in holding stacks of erected containers on the pallet for shipping and handling. It is shown in detail in FIG. 5, along with a schematic showing for orientation of the tops of containers. As illustrated, the top frame includes a pair of L-shaped end boards 34 which capture the upper ends of the containers, which boards are relieved as shown to accommodate upstanding projections on erected containers. Such end boards are connected by slats 36, and a center board 37 is provided that is relieved as is appropriate to accommodate and capture projections on the upper containers.

As can be seen from FIGS. 5 and 6B, a pair of conventional flexible bands 38 are provided to hold the assemblage of pallet, containers and top frame together. Each of these bands extends about the top deck of the pallet upwardly along the containers as shown and across the top frame. In this connection, as is illustrated in FIG. 5, frame slats 36 are relieved at 39 to accommodate the flexible bands.

Figure 7:
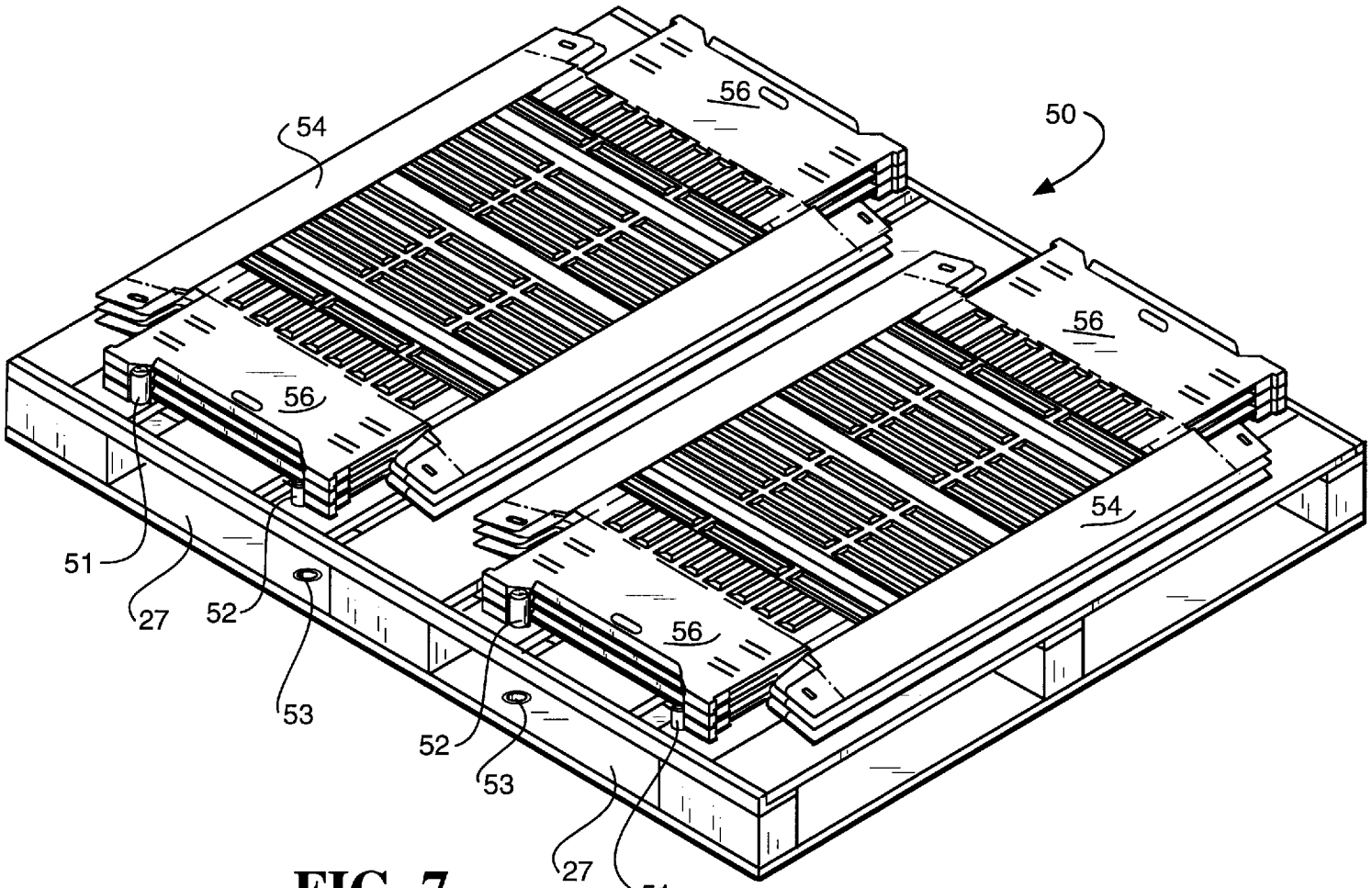
FIG. 7 is an isometric view of another embodiment of the invention, showing the same with a plurality of collapsed containers.
Figure 8:
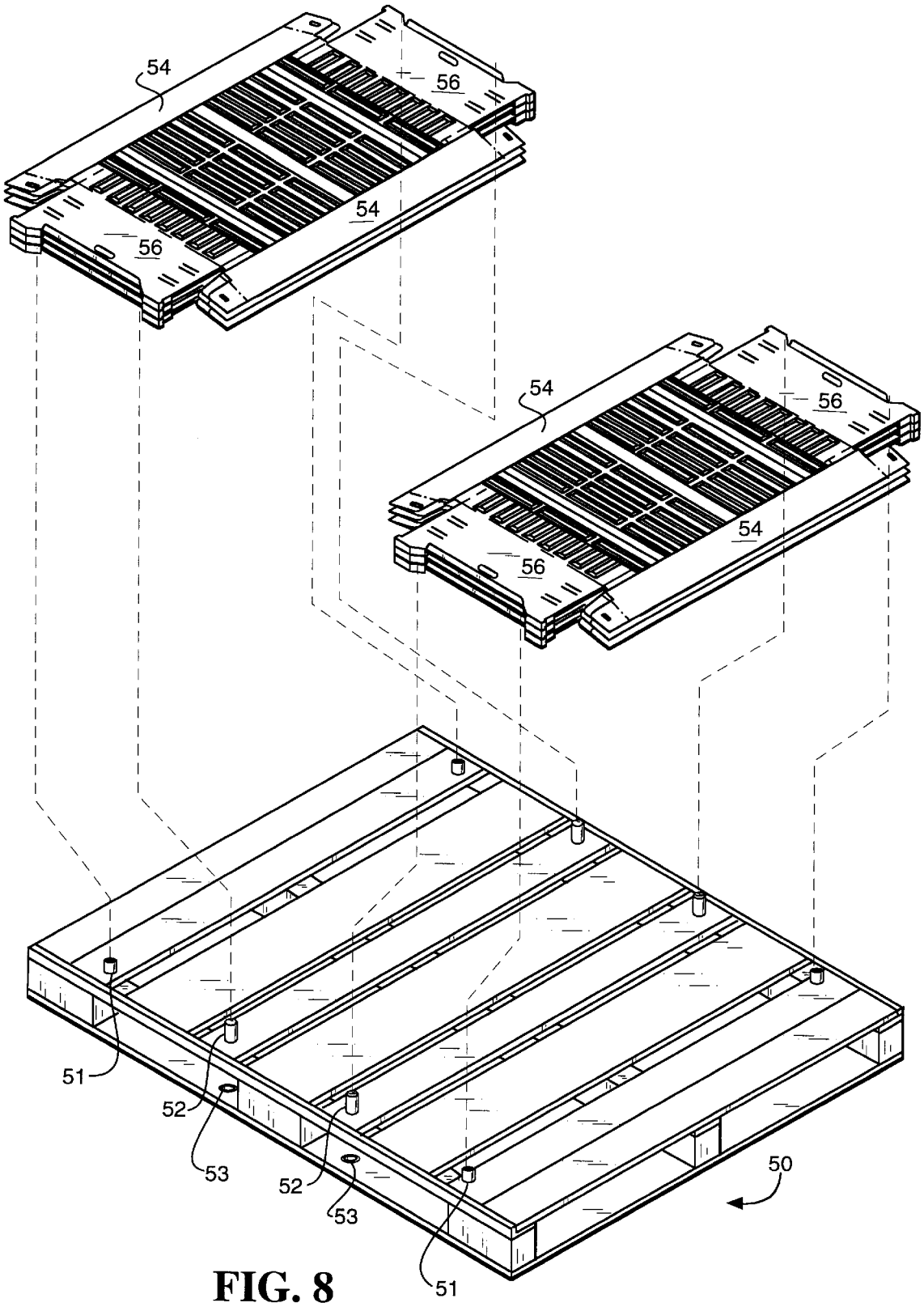
FIG. 8 is a view similar to FIG. 7 but showing the collapsed containers exploded away from the pallet.

The basic pallet of the invention also forms the basis for a modified pallet usable to ship, in their collapsed condition, containers of the type described in the above patent. FIGS. 7 and 8 illustrates such a modified pallet with a few collapsed containers for illustration. As brought out in the earlier patent, the containers when they are in their collapsed condition nest and interlock with one another. It is the container end frames which are primarily responsible for this nesting and interlocking. FIG. 7 shows the collapsed containers in place, whereas FIG. 8 shows them exploded away from the pallet. Pallet 50 differs from the pallet illustrated in FIG. 1 simply by the addition of posts 51 and 52 on its upper deck and bore holes 53 in the bottom deck that are axially aligned with such posts. (It should be noted that each of the bore holes 53 includes a bushing insert which closes the bores through the board 27 of the pallet.) It will be appreciated that although not shown, the side of the pallet opposite the side illustrated includes correspondingly positioned and sized posts 52 and bore holes 53. Although the collapsed containers with which the pallet is usable correspond to the one illustrated and described in the previously mentioned patent, they differ in that they are deeper. That is, the side panels included folded over flaps 54, which flaps cooperate with the remainder of the panel when the container is erected to define a deeper side. Also the ends 56 of the containers are elongated as necessary to cooperate with the sides in providing increased depth, and it is these ends that have the container end frames which are primarily responsible for the nesting and interlocking.

As shown, posts 51 and 52 are spaced at appropriate distance from one another to accommodate the collapsed containers with the container ends captured by such posts.

Figure 9:
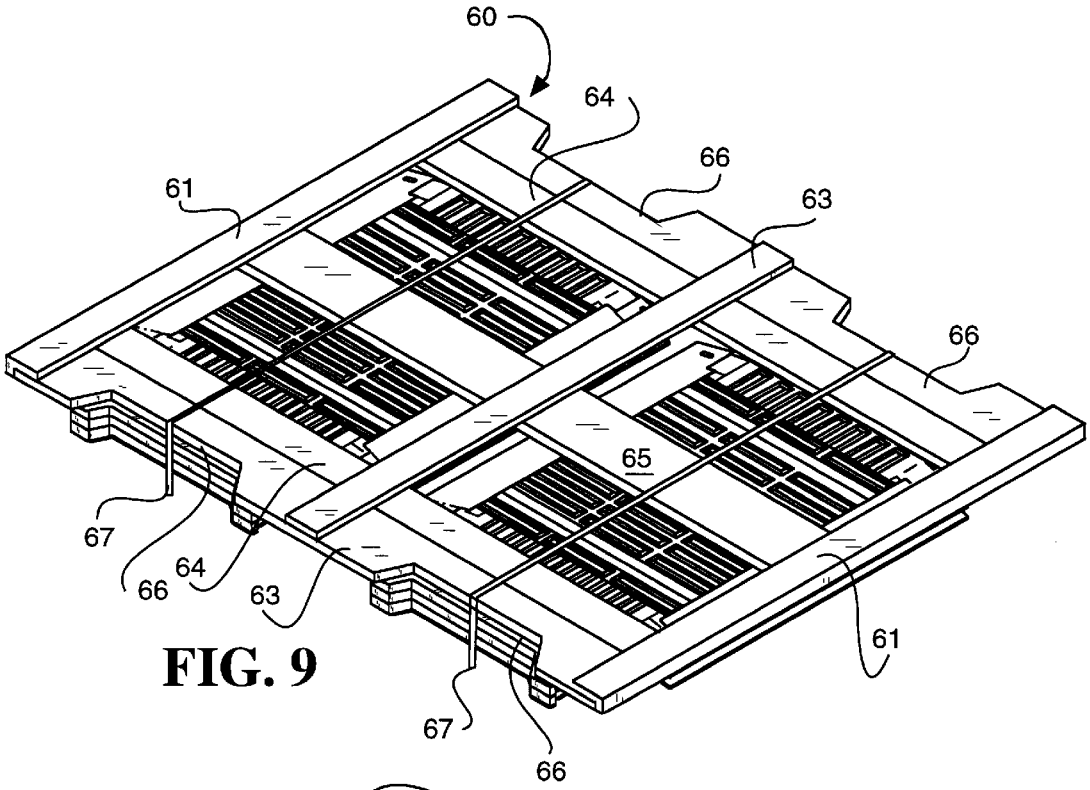
FIG. 9 is an isometric view showing a top frame usable with the pallet of FIGS. 7 and 8.

A top frame 60 is also included in this embodiment to assure reliable holding of a stack of collapsed containers. FIG. 9 illustrates such top frame along with the containers at the top of a stack. It is similar in many respects to the frame provided for erected containers. In this connection, such top frame includes a pair of L-shaped end boards 61 made from the same extruded stock as the L-shaped end boards 21 of the pallet top deck section. The cross bar 65 corresponds to the cross bars and center board 18 of the top pallet section, except that it is provided with energy directors as illustrated by FIG. 3F.

It further includes five cross slats, a pair of cross slats 63 and 64 at each end and a center cross slat 65. An end view of the slats 63 is shown in FIG. 3G. As can be seen, the slats are basically the same as slat 19 of the top deck of the basic pallet, except that they are solid rather than of an egg crate construction. (It is preferable that they be solid in order to prevent exposure of an open interior when they are cut out to form the relieved portions 66 discussed below.) The slats 64 are made from the very same stock as that of the cross slats 19 of the pallet top deck, i.e., are extruded egg crate corresponding to FIG. 3D. The primary reason for including these slats is to assure that the end frames of collapsed containers are covered so that pressure applied to the same by the top frame assembly and items on it will be uniformly distributed.

Figure 11:
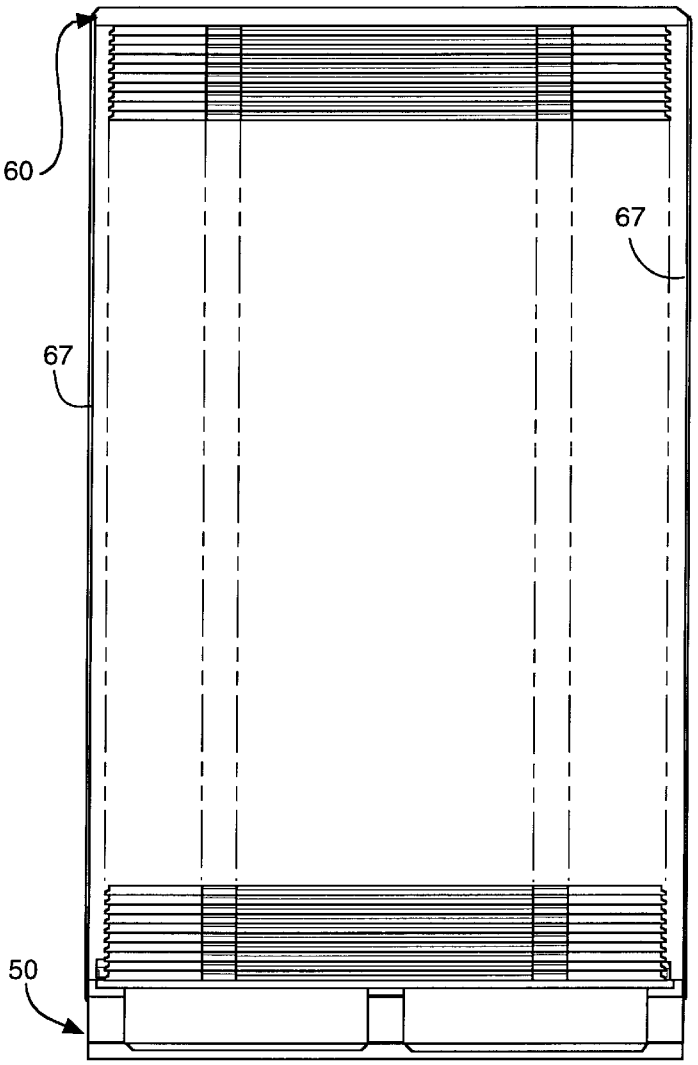
FIG. 11 is a side view similar to that of FIG. 10.
Figure 10:
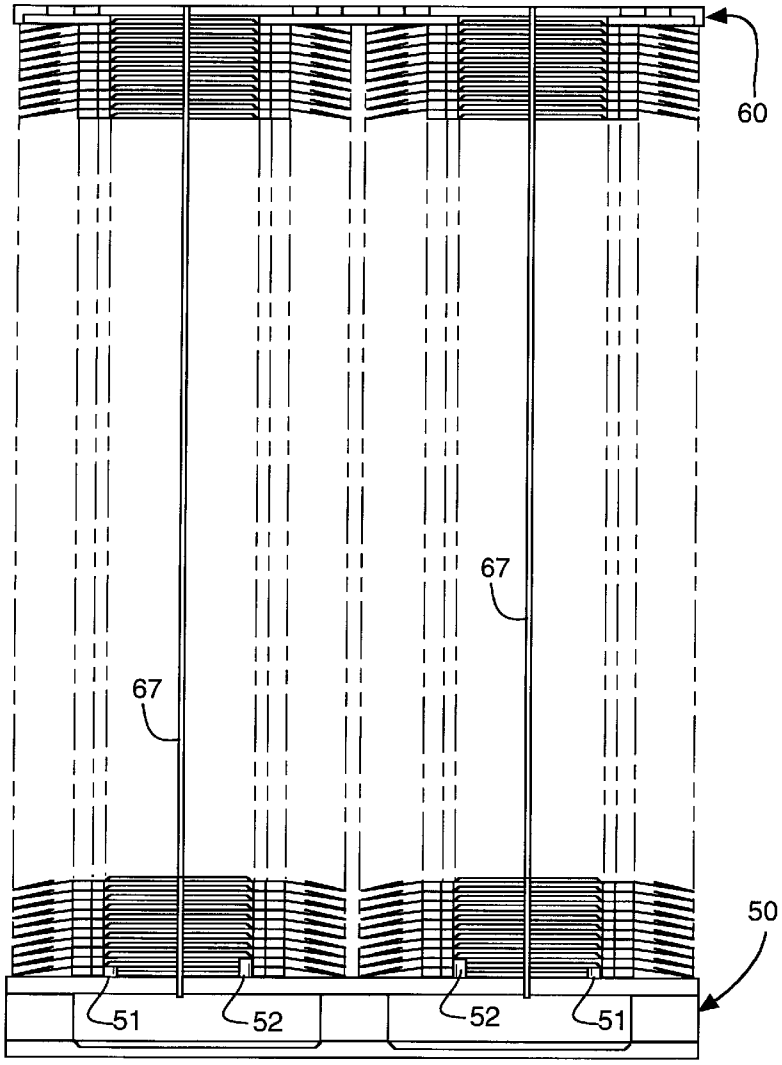
FIG. 10 is a front view of the pallet of FIGS. 7 and 8 loaded with collapsed containers.

As shown, the reliefs 66 in the end slats 63 accommodates straps 67 which bear against the stacked containers to assure they are held in place. FIGS. 10 and 11 show the resulting structures when a large number of collapsed containers are secured with top frames to pallets of the invention designed for the same.

Figure 12:
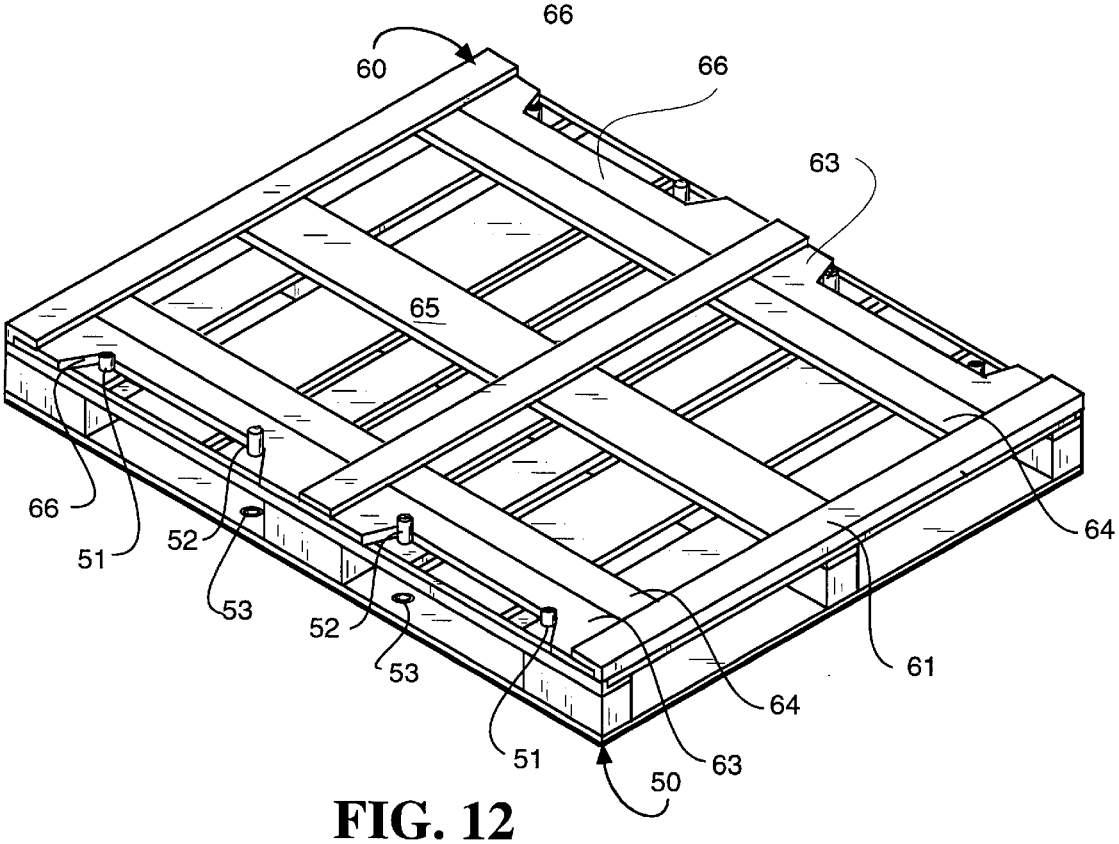
FIG. 12 is an isometric view of the top frame shown in FIG. 9 and the pallet of FIGS. 7 and 8 illustrating the manner in which the frame and pallet cooperate.
Figure 13:
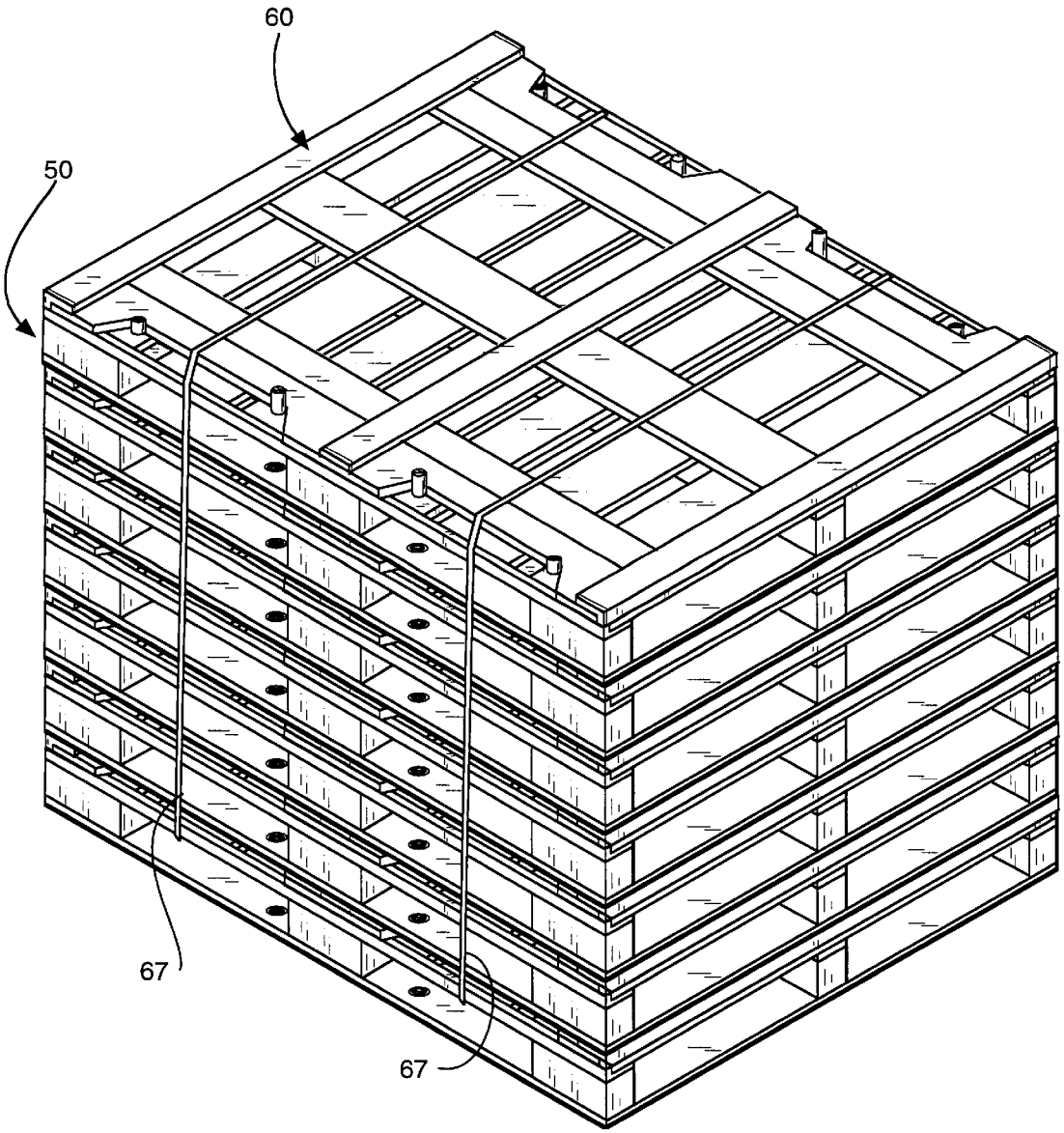
FIG. 13 is an isometric view of a number of pallet/top frame combinations of FIG. 12, assembled for shipping.

It is desirable in many situations to ship the containers in their collapsed condition. It is for this reason that the pallet 50 and its associated top frame 60 are provided. It is then desirable that the pallets and top frames designed for collapsed containers be returned. Such pallets and top frames are designed to nest together to facilitate such returning. FIGS. 12 and 13 illustrate the same, FIG. 12 showing one pallet/top frame combination whereas FIG. 13 shows many stacked together for simple transportation and handling. With reference to FIG. 12, it will be seen that the relieved portions 66 on the top frame accommodate posts 51 and 52 on the pallet. Thus, such posts provide at least two different functions, the function of containing the lower collapsed containers in proper location and the function of later assuring proper registration of the top frame for the container. FIG. 13 shows numerous collapsed container pallets and top frame combinations stacked together. It will be seen that the holes 53 in one pallet accommodate the posts 52 of the lower pallet. Moreover, straps 67 are included to maintain the stacked combinations together.

Figure 14:
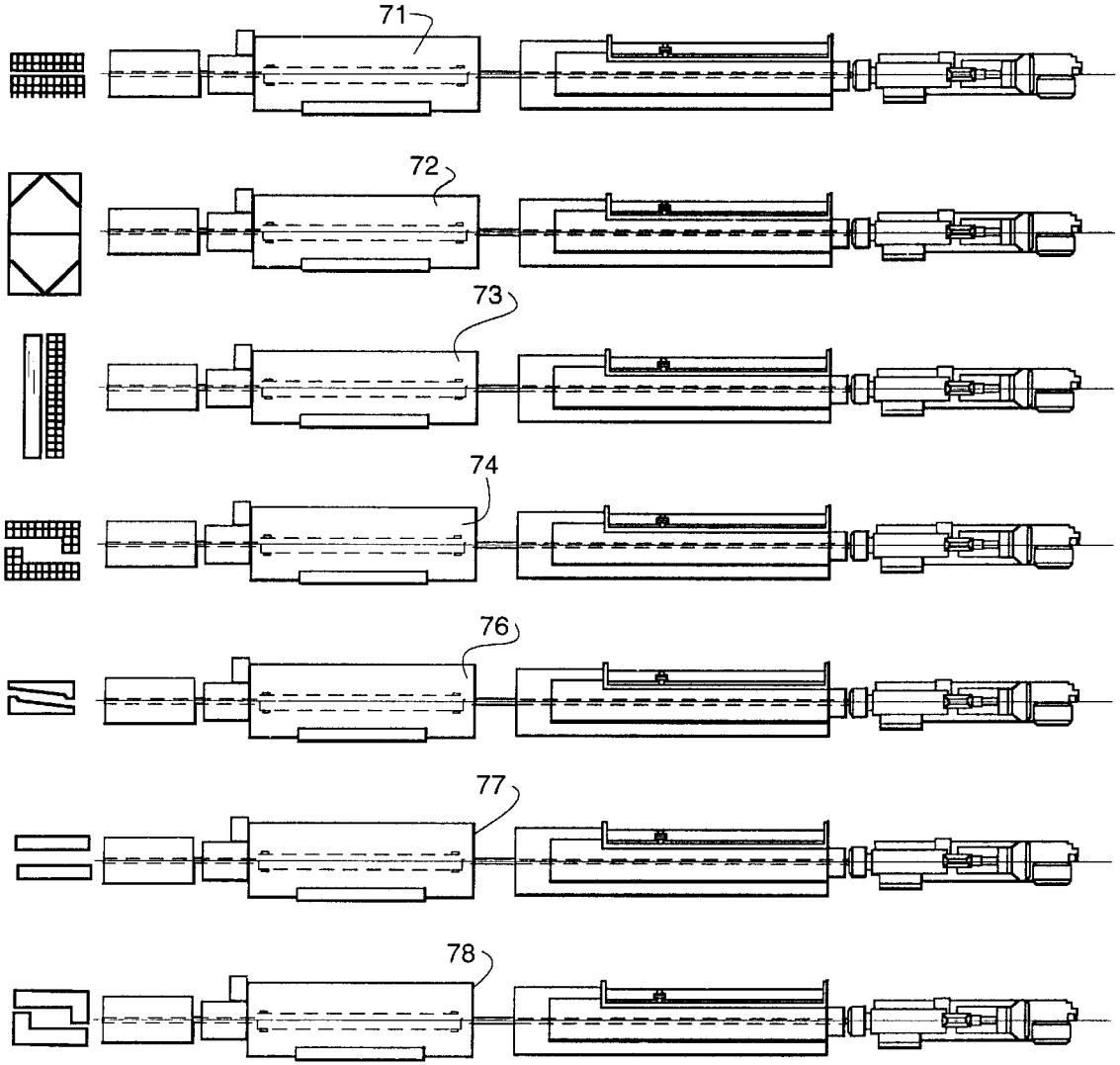
FIG. 14 is a schematic view illustrating extrusion lines for providing the common stock needed to make the pallets of FIGS. 1 and 4 and the top frames shown in FIGS. 5 and 9.

As mentioned previously, the pallet design is such that most of the parts can be made from common pieces of extruded stock. FIG. 14 is a schematic view illustrating this point. On the left hand side as viewed can be seen sections of extruded stock produced by each of such lines. As illustrated, only four lines, lines 71–74, provide all of the stock needed for the major parts of the basic pallet. And only three others, lines 76–77, are needed to provide the additional parts needed for the pallet and top frames for erected and collapsed plastic containers of the type disclosed in U.S. Pat. No. 5,450,962. In this connection, line 76 extrudes the stock needed to make the runners utilized for the erected container pallet of FIG. 4, and lines 77 and 78 extrude stock for frame boards used in the two top frames.

As mentioned at the beginning of the detailed description, applicant is not limited to the specific embodiments and variations described above. The claims, their equivalents and their equivalent language define the scope of protection.

What is claimed is:

1. A rugged but lightweight pallet having a construction provided by differing parts creatable from common plastic stock, comprising as discrete sections:

A) a top deck section defining a pallet surface for interacting with goods to be transported, said pallet surface including both a plurality of cross bars and a pair of edge boards each of said edge boards closing one end of said cross bars;

B) a bottom deck section for engaging a supporting surface; and

C) a plurality of spacer blocks extending from and secured between said top and bottom deck sections, spacing said deck sections apart to define channels therebetween for receipt of pallet pick-up tines:

wherein said spacer blocks are formed from a common piece of plastic stock and said spacer block stock is extruded with a generally hollow interior but with strengthening webbing to support the walls of the block, and each of said spacer blocks is oriented relative to the top and bottom decks so that the latter close those opposed ends of the block at which said hollow interior and webbing are exposed; and wherein said spacer block stock is generally rectangular in cross-section with two pair of opposed exterior walls, and said webbing within said stock and, hence, within each of said spacer blocks includes an internal cross wall extending between opposed exterior walls of said stock and a pair of opposed chevrons respectively connecting the center of the other opposed walls to a portion of the first opposed walls supported by said interior cross wall.

2. A rugged but lightweight pallet having a construction provided by differing parts creatable from common plastic stock, comprising as discrete sections:

A) a top deck section defining a pallet surface for interacting with goods to be transported, said pallet surface including both a plurality of cross bars and a pair of edge boards each of said edge boards closing one end of said cross bars;

B) a bottom deck section for engaging a supporting surface; and

C) a plurality of spacer blocks extending from and secured between said top and bottom deck sections, spacing said deck sections apart to define channels therebetween for receipt of pallet pick-up tines:

wherein said cross bars are formed from a common piece of stock and the cross bar stock has a generally hollow interior with webbing therein to provide support for its exterior walls, each cross bar formed therefrom thereby having a pair of opposed open ends; and said top deck section includes a pair of spaced edge boards against which said cross bars abut with the opposed open ends thereof closed by said edge boards.

3. The pallet of claim 2 wherein said cross bars are vibration welded to said edge boards.

4. The pallet of claim 2 wherein said cross bars are formed from a common piece of plastic stock and wherein said bottom deck section has frame pieces made from said cross bar stock.

5. A rugged but lightweight pallet having a construction provided by differing parts creatable from common plastic stock, comprising as discrete sections:

A) a top deck section defining a pallet surface for interacting with goods to be transported, said pallet surface including both a plurality of cross bars and a pair of edge boards each of said edge boards closing one end of said cross bars;

B) a bottom deck section for engaging a supporting surface; and

C) a plurality of spacer blocks extending from and secured between said top and bottom deck sections, spacing said deck sections apart to define channels therebetween for receipt of pallet pick-up tines:

wherein there are two sets of said cross bars, which sets differ in configuration, and there are a corresponding two differing pieces of cross bar stock from which they are formed.

6. The pallet of claim 2 wherein each of said edge boards is L-shaped in section with a leg thereof defining a surface configured to close corresponding ends of a plurality of said cross bars.

7. The pallet of claim 6 wherein each of said edge boards includes a plurality of energy directors on another leg of said edge boards, to facilitate rigid connection of said edge board to said cross bars by welding of the energy directors.

8. The pallet of claim 2 wherein the pallet surface provided by said top deck section includes a plurality of interlocking strips for interlocking with containers to be carried by said pallet.

9. The pallet of claim 8 wherein there are four of said interlocking strips on said pallet surface, which strips are parallel to one another with a pair of strips adjacent opposed edges of said top deck section and a pair of said strips adjacent the center of said surface.

10. A rugged but lightweight pallet having a construction provided by differing parts creatable from common plastic stock, comprising as discrete sections:

A) a top deck section having a pallet surface for interacting with goods to be transported, said top deck section including a plurality of cross bars made from a common piece of stock of material, each of said cross bars having a pair of opposed open ends; and a pair of edge boards at the edges, said edge boards being individually L-shaped in section with a leg thereof closing an opposed end of said bars, which edge boards are made from a common piece of stock material different from said piece of stock of material from which said cross bars are made;

B) a bottom deck section for engaging a supporting surface, said bottom deck section having frame pieces made from the same common piece of stock from which said cross bars of said top deck section are made; and C) a plurality of spacer blocks extending and secured between said top and bottom deck sections, spacing said deck sections apart to define channels therebetween for receipt of pallet pick-up tines, said spacer blocks also being formed from a common piece of plastic stock that is extruded with a generally hollow interior but with strengthening webbing to support the walls of the block, each of said spacer blocks being oriented relative to the top and bottom decks so that said decks close opposed ends of the same at which said hollow interior and webbing are exposed.

11. The pallet of claim 10 wherein said top deck section includes a plurality of interlocking strips for interlocking with containers to be carried by said pallet; and wherein there are four of said interlocking strips on said pallet surface, which strips are parallel to one another with a pair of strips adjacent opposed edges of said top deck section and a pair of said strips adjacent the center of said surface.

* * * * *